US008672565B2

(12) United States Patent
Vandermeulen

(10) Patent No.: US 8,672,565 B2
(45) Date of Patent: Mar. 18, 2014

(54) TAPE PRINTING APPARATUS AND OUTLET THEREFOR

(75) Inventor: Kris Vandermeulen, Bornem (BE)

(73) Assignee: Sanford, L.P., Oak Brook, IL (US)

( * ) Notice: Subject to any disclaimer, the term of this patent is extended or adjusted under 35 U.S.C. 154(b) by 514 days.

(21) Appl. No.: 12/594,584

(22) PCT Filed: Apr. 7, 2008

(86) PCT No.: PCT/EP2008/054179

§ 371 (c)(1),
(2), (4) Date: Oct. 13, 2009

(87) PCT Pub. No.: WO2008/122634

PCT Pub. Date: Oct. 16, 2008

(65) Prior Publication Data

US 2010/0119284 A1 May 13, 2010

(30) Foreign Application Priority Data

Apr. 5, 2007 (GB) ..... 0706785.3

(51) Int. Cl.
*B41J 11/70* (2006.01)
*B41J 3/36* (2006.01)

(52) U.S. Cl.
USPC ..... 400/88; 400/621; 400/693

(58) Field of Classification Search
CPC ..... B41J 3/4075
USPC ..... 400/88, 693, 621; 221/70, 74, 303
See application file for complete search history.

(56) References Cited

U.S. PATENT DOCUMENTS

| | | | | |
|---|---|---|---|---|
| 5,163,766 | A * | 11/1992 | Fushimi et al. | 400/692 |
| 5,253,334 | A * | 10/1993 | Kimura et al. | 358/1.2 |
| 5,435,659 | A * | 7/1995 | Ueno | 400/615.2 |
| 6,074,113 | A * | 6/2000 | Cockerill et al. | 400/621 |
| 6,491,460 | B1 * | 12/2002 | Sodeyama et al. | 400/613.1 |
| 6,602,009 | B2 * | 8/2003 | Sodeyama | 400/621 |
| 6,646,649 | B1 * | 11/2003 | Tanabe et al. | 345/588 |
| 6,652,173 | B1 | 11/2003 | Martini et al. | |
| 2001/0041087 | A1 | 11/2001 | Kurashina | |
| 2002/0094222 | A1 * | 7/2002 | Furuya et al. | 400/615.2 |
| 2004/0265027 | A1 * | 12/2004 | Hine et al. | 400/76 |
| 2006/0039738 | A1 * | 2/2006 | Murata et al. | 400/615.2 |

FOREIGN PATENT DOCUMENTS

| | | | |
|---|---|---|---|
| CN | 1284435 | A | 2/2001 |
| EP | 0 267 890 | A2 | 5/1988 |
| EP | 0 322 918 | A2 | 7/1989 |
| EP | 0 578 372 | A2 | 1/1994 |

(Continued)

OTHER PUBLICATIONS

Office Action from Chinese Patent Application No. 200880017455.7, dated Dec. 21, 2010 (with translation).

(Continued)

*Primary Examiner* — Daniel J Colilla
(74) *Attorney, Agent, or Firm* — Marshall, Gerstein & Borun LLP

(57) ABSTRACT

A tape printing apparatus including a tape accommodation area for accommodating a supply of image receiving tape; a cutting arrangement; an outlet arranged adjacent said cutting arrangement, the outlet having a first part downstream of the cutting arrangement with a size such that a user is able to access an area adjacent the cutting arrangement.

11 Claims, 6 Drawing Sheets

(56) References Cited

FOREIGN PATENT DOCUMENTS

| | | | | | |
|---|---|---|---|---|---|
| EP | 0 712 226 | A1 | | 5/1996 | |
| EP | 0 841 182 | A2 | | 5/1998 | |
| EP | 10-162796 | A | | 6/1998 | |
| EP | 1 084 851 | A2 | | 3/2001 | |
| EP | 1 493 588 | A1 | | 1/2005 | |
| JP | 03096379 | A | * | 4/1991 | ..... B41J 15/04 |
| JP | 09141951 | A | * | 6/1997 | ..... B41J 11/66 |
| JP | 09314948 | A | * | 12/1997 | ..... B41J 15/04 |
| JP | 11-191023 | A | | 7/1999 | |
| JP | 11301043 | A | * | 11/1999 | ..... B41J 11/70 |
| JP | 2003063071 | A | * | 3/2003 | ..... B41J 3/36 |
| JP | 2004122381 | A | * | 4/2004 | ..... B41J 3/36 |
| WO | WO-2005/029612 | A1 | | 3/2005 | |

OTHER PUBLICATIONS

European Search Report for Application No. GB0706785, mailed Sep. 20, 2007.

International Search Report for Application No. PCT/EP2008/054179, mailed Feb. 4, 2009.

* cited by examiner

TAPE PRINTING APPARATUS AND OUTLET THEREFOR

REFERENCE TO RELATED APPLICATIONS

This is the United States National Phase of PCT/EP2008/054179, having an international filing date of Apr. 7, 2008, which claims priority to GB 0706785.3, filed Apr. 5, 2007.

FIELD OF THE INVENTION

The present disclosure relates to a tape printing apparatus.

BACKGROUND

Tape printing apparatus are known in for example EP-A-322918 (Brother Kogyo Kabushiki Kaisha) and EP-A-267890 (Varitronics). The known tape printing apparatus comprises a cassette receiving bay for receiving a cassette or tape holding case. In EP-A-267890, the tape holding case houses an ink ribbon and a substrate tape, the latter comprising an upper image receiving layer secured to a backing layer by an adhesive. In EP-A-322918, the tape holding case houses an ink ribbon, a transparent image receiving tape and a double-sided adhesive tape which is secured at one of its adhesive coated sides to the image tape after printing and which has a backing layer peelable from its other adhesive coated side. With this tape printing apparatus, the image transfer medium (ink ribbon) and the image receiving tape (substrate) are in the same cassette.

It has also been proposed by the present applicant in, for example EP-A-578372 to house the ink ribbon and the substrate tape in separate cassettes.

In all of these cases, the image receiving tape passes in overlap with an ink ribbon to a printing zone consisting of a print head and a platen which cooperate to cause an image to transfer from the ink ribbon to the image receiving tape. There are many ways in doing this, including dry lettering or dry film impression but the most usual way currently is by thermal printing where the print head is heated and the heat causes ink from the ink ribbon to be transferred to the image receiving tape.

It is also known for the ink ribbon to be omitted and an image to be printed directly on the image receiving tape by heating the print head. This process is called direct thermal printing.

Generally, the tape housed in a cassette is continuous and accordingly known tape printers include a cutter for cutting the tape. With the known arrangements, an image is printed on the tape by the print head and then, downstream of the printing, the tape is cut. The cut tape can then be removed from an exit slot of the tape printer. The images which are printed on the tape have a blank portion, that is a margin. The size of this margin is determined by the configuration of the tape printer. The margin generally cannot be smaller than the distance between the cutter and the print head if reverse feeding of the tape is avoided. Secondly, the margin is such that the minimum label size is generally greater than the distance between the cutter and the exit slot of the tape printer, so that the label can be removed. To minimise this second distance, a so-called spitter mechanism has been proposed where the label is driven out of the tape printer. Such a spitter mechanism whilst being effective does require additional components in order to be implemented.

Known tape printers are often battery powered. It has been proposed that such a tape printer be powered by a plurality of individual batteries accommodated in a battery compartment.

It has been proposed that as an alternative to these individual batteries that a battery pack be used. Such a battery pack generally incorporates its own lid for ease of insertion and removal in the tape printer. However, if the user usually uses the battery pack but on occasion wants to use individual batteries, the user may find that he has lost the lid to the battery compartment. This can be inconvenient for the user.

Some known tape printing apparatus are generally designed to be portable so that they can be used in an environment other than at a desk. For example, some tape printers are used by electricians, plumbers or the like. It is therefore not unknown for the tape printing apparatus to be dropped or bumped. It has been proposed to provide a removable rubber cover to protect portions of the tape printing apparatus. Some known versions, of these protective rubber covers, are removable or are stuck or screwed to the housing. In the case of removable covers, they can be difficult to put on and remove and over time, there may be degradation in the elasticity of the cover leading to degradation in the protective performance. In the case where the cover is stuck to the housing, this increases the complexity of the manufacturing process.

SUMMARY

It is an aim of one or more embodiments of the present disclosure to address or at least mitigate one or more of the problems set out above.

According to an aspect, there is provided a tape printing apparatus comprising: an tape accommodation area for accommodating a supply of image receiving tape; a cutting arrangement; an outlet arranged adjacent said cutting arrangement, said outlet having a first part downstream of the cutting arrangement with a size such that a user is able to access an area adjacent said cutting arrangement, said tape accommodation area being arranged to accommodate said supply of image receiving tape in a cassette and said outlet is sized to permit a user to contact a surface of said cassette via said outlet.

According to an aspect, there is provided, tape printing apparatus comprising: an tape accommodation area for accommodating a supply of image receiving tape; a cutting arrangement; an outlet arranged adjacent said cutting arrangement, said outlet having a first part downstream of the cutting arrangement with a size such that a user is able to access an area adjacent said cutting arrangement. Furthermore, there is a second part upstream of the first part, the second part being sized such that access to the cutting arrangement by a user is prohibited, the second part having a length between 10 and 20 mm. In a particular aspect, one wall of the first part is a continuation of a wall of the second part. In another particular aspect, the second part includes first and second parallel wall portions defining a path for the image receiving tape, and first and second walls of the first part are asymmetric with respect to the second part.

According to an aspect, there is provided a tape printing apparatus comprising: an tape accommodation area for accommodating a supply of image receiving tape; a cutting arrangement; an outlet arranged adjacent said cutting arrangement, said outlet comprising a least one curved wall.

According to an aspect, there is provided, a tape printing apparatus comprising: a housing; a cassette receiving bay and an associated lid; a battery compartment and an associated lid, wherein each of said housing, cassette receiving bay lid and battery compartment lid being at least partially covered by a protective material.

According to an aspect, there is provided tape printing apparatus comprising: a housing and a plurality of feet, said housing being a least partially covered by a protective material, said plurality of feet being provided by said protective material.

According to an aspect, there is provided a tape printing apparatus comprising: a housing; a cassette receiving bay and an associated lid; a battery compartment and an associated lid, wherein each of said housing and said cassette receiving bay lid being at least partially covered by a protective material, said battery compartment lid being free of protective material.

According to an aspect, there is provided a battery arrangement for use with a tape printing apparatus, said battery arrangement comprising a battery pack and a support, said battery pack being removably attached to said support.

For a better understanding of the present disclosure and as to how the same may be carried into effect, reference will now be made by way of example to the accompanying drawings in which:

DETAILED DESCRIPTION OF THE PREFERRED EMBODIMENTS

Figure 1:
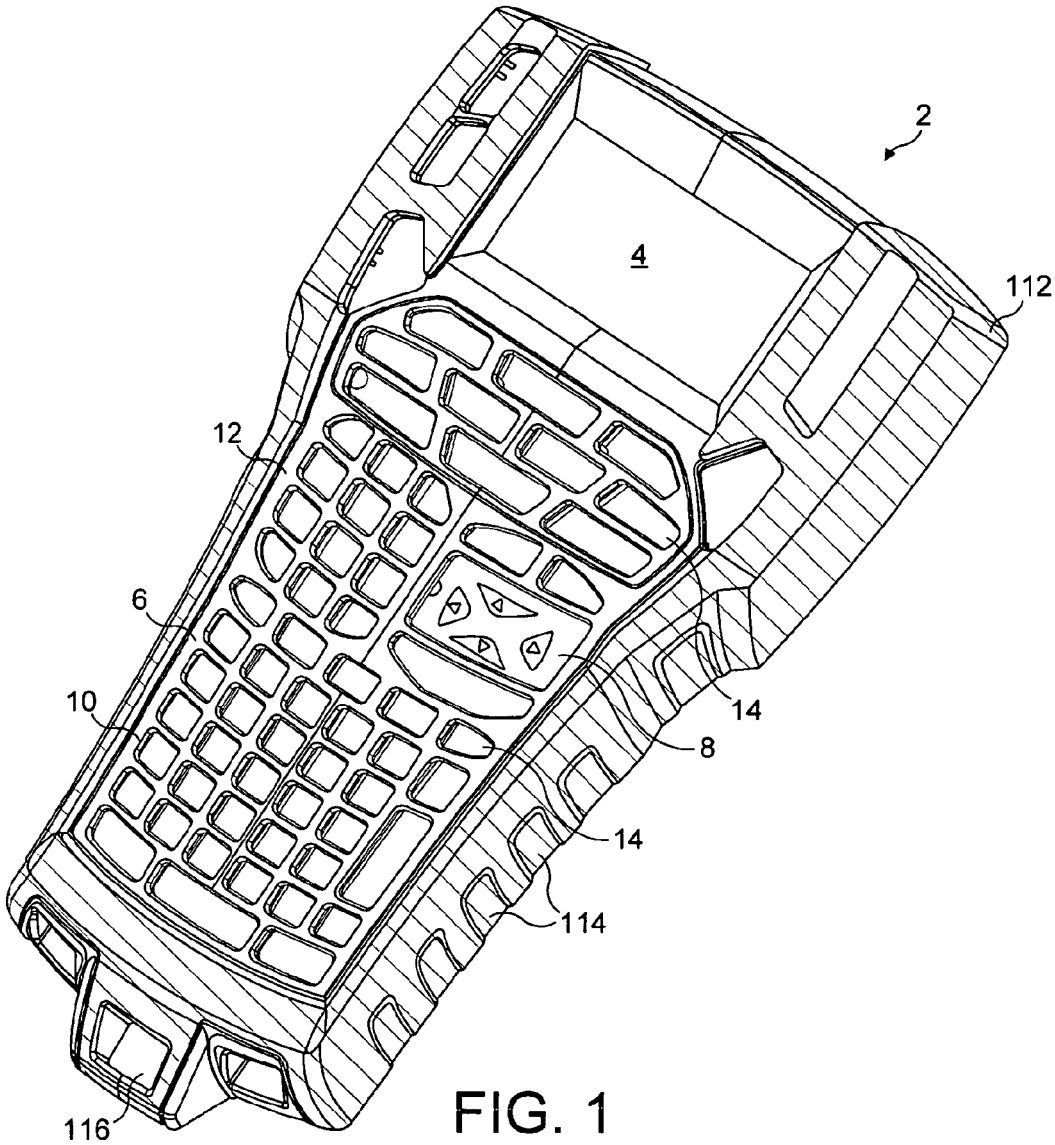
FIG. 1 shows a perspective view from above of a tape printing apparatus embodying the present disclosure.

FIG. 1 shows the front of a tape printing apparatus 2. The printing apparatus has a display 4. In preferred embodiments of the present disclosure, the display 4 is a liquid crystal display. The tape printing apparatus has a keyboard 6. The keyboard 6 has a plurality (in this case four) cursor control keys 8. Also provided are a plurality of keys 10 for selecting characters and a plurality of keys 12 for selecting numbers. The keyboard 6 also has two sets of function keys 14. It should be appreciated that the number of keys provided and the functions provided by those keys can be varied in accordance with the application of the printer. For example, in one embodiment the individual keys for the numbers can be omitted and instead the number keys may be accessed via character keys. Another modification avoids the requirement for a single key for each character. Alternatively, functions may be accessed by use for example of a shift key.

The keyboard 6 thus allows the user to input an image including characters, number and/or symbols. The function keys allow the attribute of the labels to be selected. The function keys 14 thus allow different functions to be implemented and may control the operational mode of the tape printing apparatus.

In one alternative embodiment of the present disclosure, the keyboard can be replaced by a touch-pad, a touch-screen or any other input means.

Figure 7:
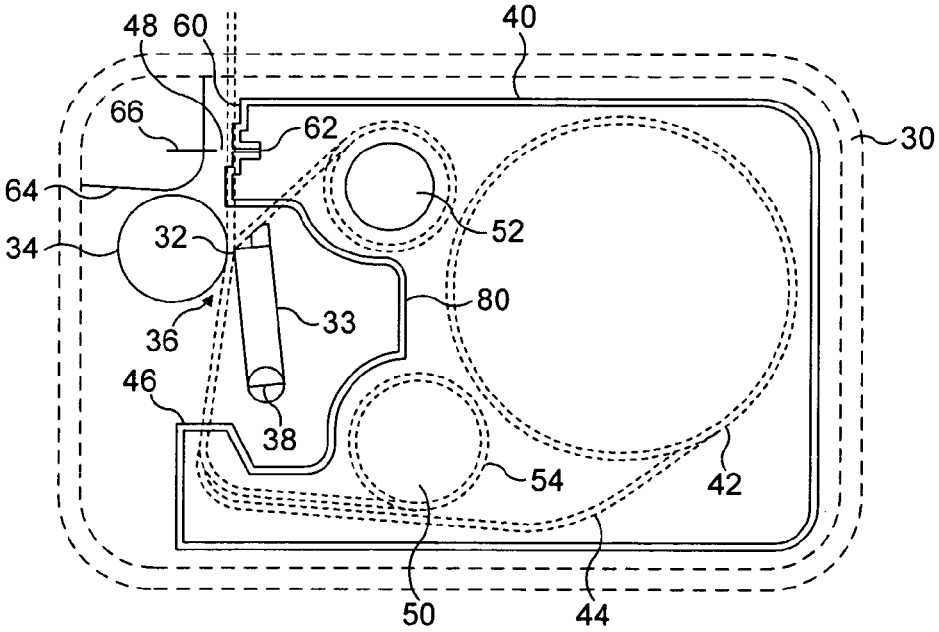
FIG. 7 shows a plan view of the cassette receiving bay of FIG. 2 with a cassette in place.

Reference is made to FIG. 7 which shows a cassette receiving bay which is indicated by the dotted line 30. The cassette bay 30 includes a thermal print head 32 and a rotatable platen 34 which cooperate to define a print zone 36. The cassette receiving bay can also be seen from FIG. 2 where the cassette receiving bay is covered by a lid 118 and FIG. 3 where the cassette receiving bay is uncovered. The cassette receiving bay is accessed via the rear side of the printing apparatus.

The thermal print head 32 comprises a column of printing elements. The print head 32 has a height which is generally large enough to print on the widest width of tape. The print head 32 has one printing element in each row of the column. Each of the printing elements is separately addressed and is activated in accordance with the desired image to be printed. An image can be printed with the width of characters extending along the tape or with the height of the characters extending along the length of tape in the so-called vertical printing mode.

The print head arm 33 which holds the print head holder and the printhead 32 itself can pivot about a pivot point 38 to enable the cassette to be removed and replaced in the cassette bay. A cassette inserted in the cassette bay 30 is noted generally by reference number 40. The cassette 40 holds a supply spool 42 of an image receiving tape 44. The image receiving tape 44 is guided by a guide mechanism (not shown) through the cassette 40, out of the cassette 40 through an outlet 46, past the print zone 36 to a cutting location 48.

The same cassette 40 has an ink ribbon supply spool 50 and an ink tape up spool 52. The ink ribbon 54 is guided from the ink ribbon supply spool 50 through the print zone 36 and taken up on the ink ribbon tape up spool 52. The image receiving tape 44 thus passes in overlap with the ink ribbon 54 through the print zone 36 with its image receiving layer in contact with the ink ribbon 54.

The cassette 44 has a recess 80 for receiving the print head 32. Guide portions may also be provided (not shown) for guiding the thermal transfer ribbon 54 through the print zone 36. The print head 32 is movable between an operative position in which it is in contact with the platen 34 and holds the thermal transfer ribbon 54 and the image receiving tape 44 in overlap between the print head 32 and the platen 34 and an inoperative position in which it is moved away from the platen 34 to release the ink ribbon 54 and the image receiving tape 44. In the operative position, the platen 34 is rotated to cause the image receiving tape 44 to be driven passed the print head 32 and the print head is controlled to print an image on the image receiving tape 44 by the thermal transfer of ink from the ink ribbon 54.

Figure 6:
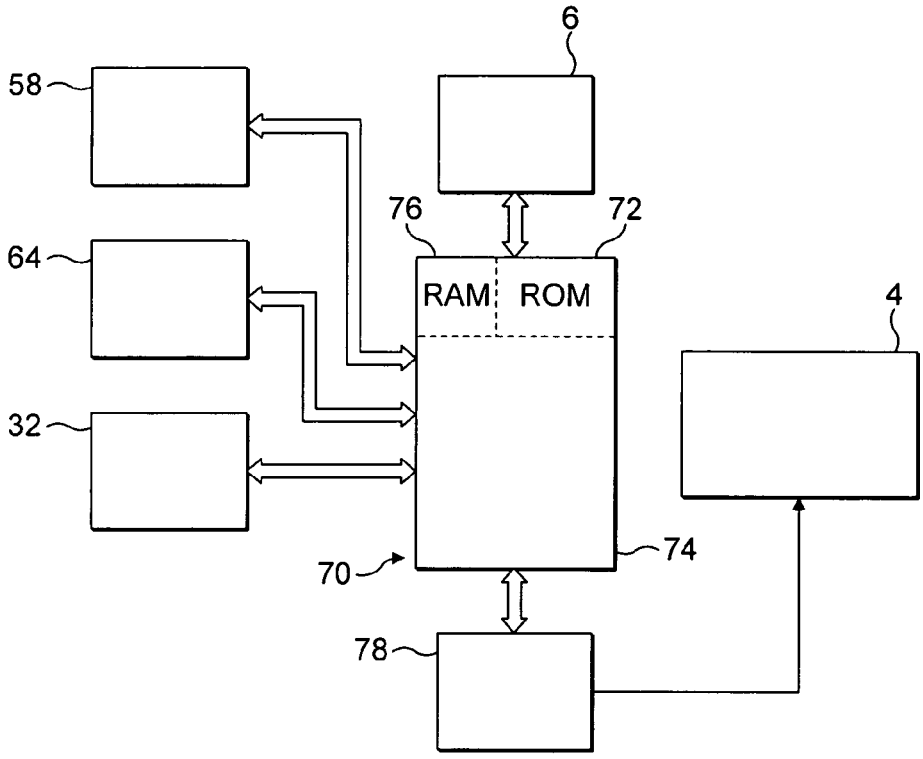
FIG. 6 is a diagrammatic sketch showing the control circuitry for the tape printing apparatus of FIG. 1.

As shown diagrammatically in FIG. 6, the platen is driven by a motor 58. The motor rotates to drive the image receiving tape through the print zone 36 continuously during printing. It is possible that the tape may be driven in a step wise manner by a stepper motor.

An image is printed on the tape fed out from the print zone 36 to the cutting location 48 which is provided at a location in a portion of the wall of the cassette 40 which is close to the print zone 36. The portion of the wall on the cassette 40 where the cutting location 48 is defined is denoted by reference number 60. A slot 62 is defined in the wall portion 60 of the cassette and the image receiving tape 44 is fed past the print zone 36 to the cutting location 48 where it is supported by facing portions on either side of the slot 62.

A cutting mechanism 64 including a cutting blade 66 is provided. The cutting blade 66 cuts the image receiving tape 44 and then enters the slot 62.

Alternatively, the cassette has a substantially flat wall portion at the cutting location 48 and the cutting blade 66 cuts the image receiving tape against the wall portion of the cassette.

Basic circuitry for controlling the tape printing apparatus is shown in FIG. 6. There is a microprocessor chip 70 having a non volatile memory 72, a microprocessor 74 and random access memory RAM capacity indicated diagrammatically by RAM 76. The microprocessor chip 70 is connected to receive label data input from a data input device such as keyboard 6.

The microprocessor chip 70 outputs data to drive display 4 via a display driver chip 78 to display a label to be printed (or part thereof) and/or other information such as a message for the user. The display driver alternatively may form part of the microprocessor chip. Additionally, the microprocessor chip 70 also outputs data to drive the print head 32 so that the label data is printed on the image receiving tape to form a label. Finally, the microprocessor chip also controls the motor 58 for driving the platen 34. The microprocessor chip may also control the cutting mechanism 64 to allow a length of tape to be cut off. In alternative embodiments of the present disclosure, at least part of the cutting mechanism may be manually operated.

Figure 2:
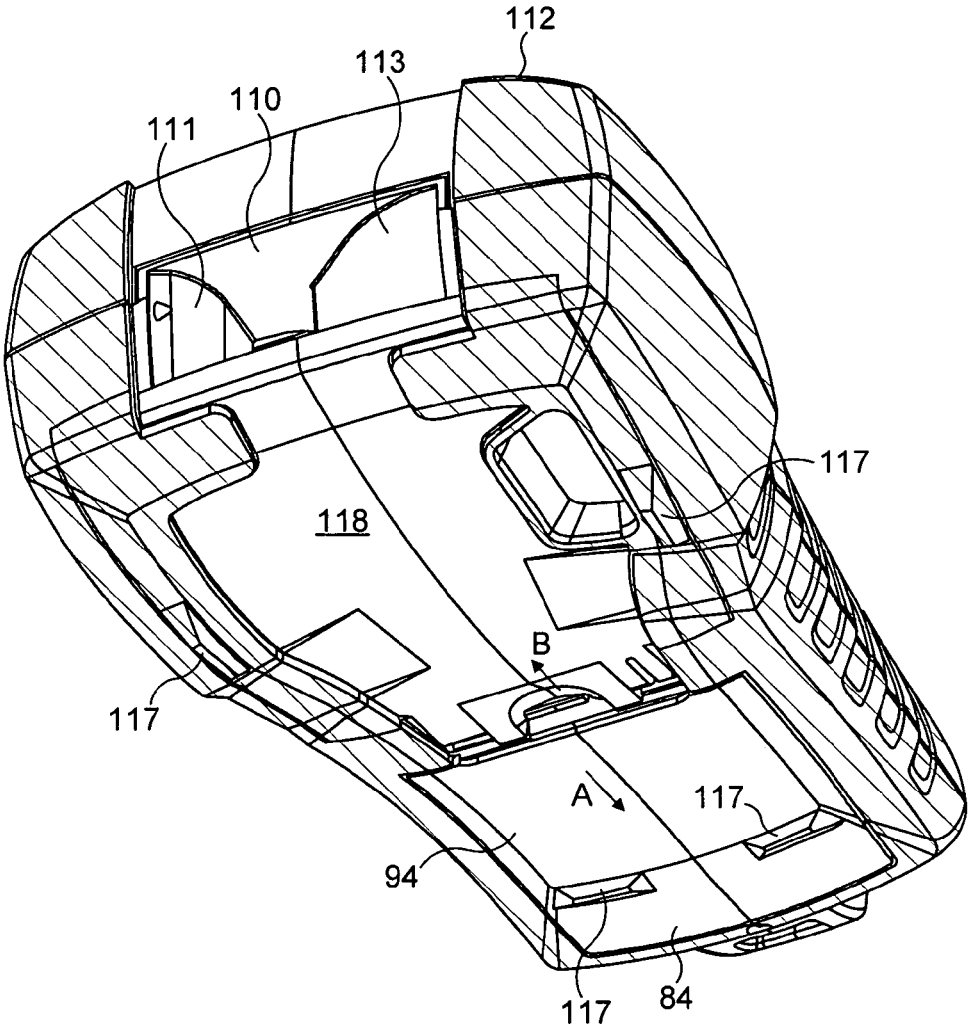
FIG. 2 shows a perspective view from the rear of the tape printing apparatus of FIG. 1.
Figure 3:
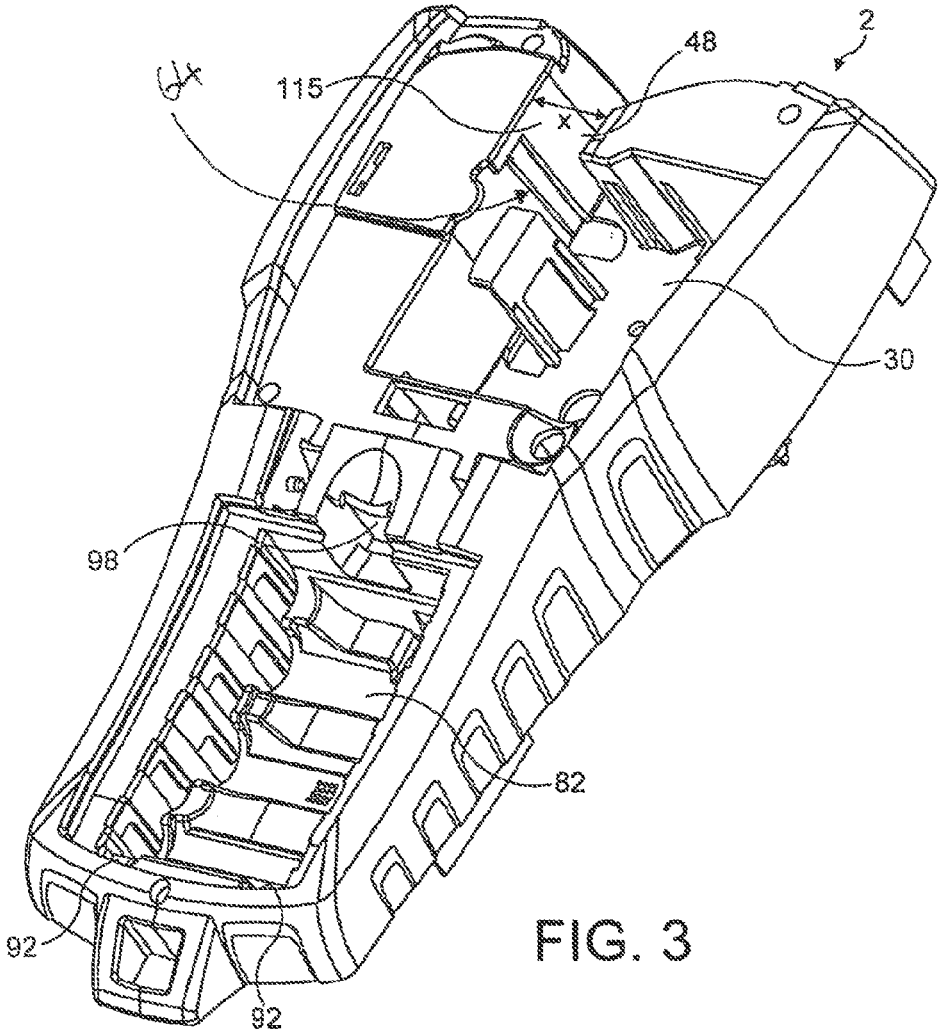
FIG. 3 shows a perspective view of the tape printing apparatus of FIG. 1, with the lids of the cassette receiving bay and the battery compartment removed.

As can be seen from FIG. 3, the cassette receiving bay 30 and a battery receiving compartment 82 are at the rear side of the tape printing apparatus 2. The battery receiving compartment is able to receive normal, non rechargeable battery, such AA or AAA or the like batteries. Alkaline batteries may be used in one embodiment. In one embodiment, six batteries may be accommodated in the battery receiving compartment 82. It should be appreciated that different number and/or types of battery may be used in alternative embodiments of the disclosure. When the batteries are in the battery receiving compartment, as illustrated in FIG. 2, the battery receiving compartment will be covered by a lid 84. The lid 84 can be seen clearly from FIG. 4*b*. Thus, the individual batteries are inserted into the battery compartment 82 and the lid 84 is used to close the compartment 82, thus stopping the batteries from falling out and retaining them in the correct position with regard to the electrical contact in the battery compartment.

Figure 4A:
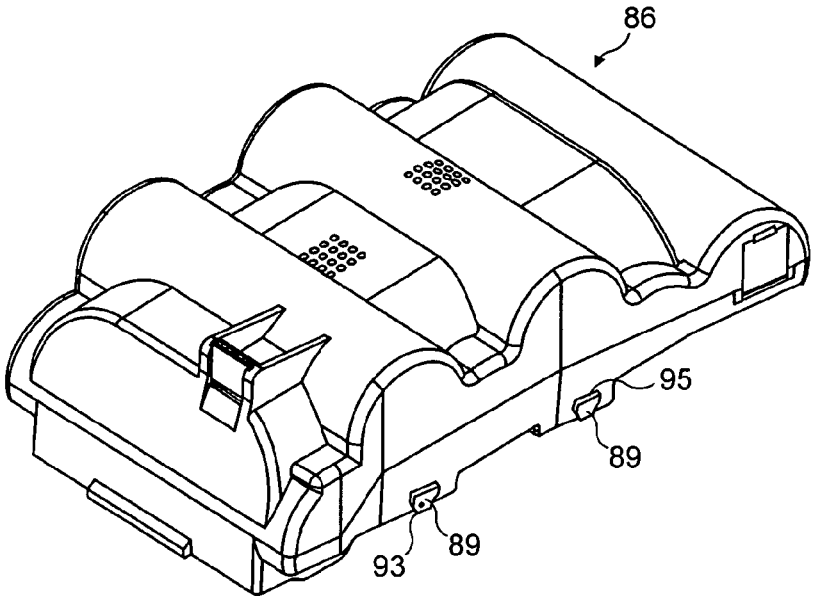
FIG. 4*a* shows a battery pack to be used in the tape printing apparatus of FIG. 1.
Figure 4B:
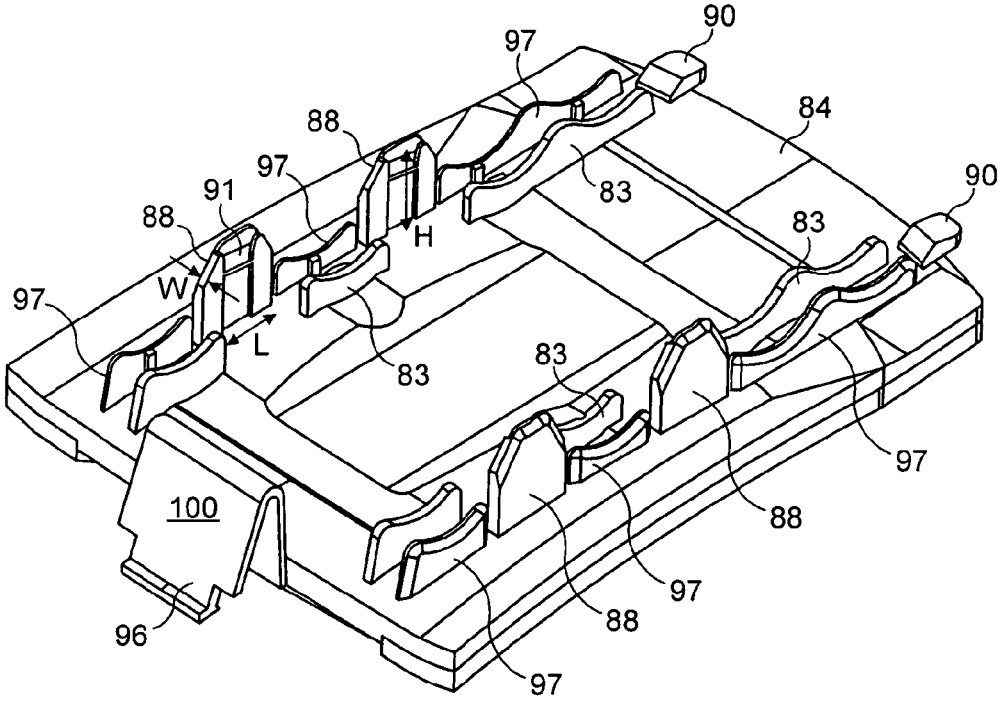
FIG. 4*b* shows the lid for the battery compartment of the tape printing apparatus of FIG. 1.

As will now be described in relation to FIGS. 4*a*, 4*b* and FIG. 5, the tape printing apparatus can be used with a so-called battery pack. The battery pack is shown in FIG. 4*a* and comprises a sealed unit containing a plurality of rechargeable batteries or a single battery unit. The rechargeable batteries can take any suitable form and for example may be nickel cadmium batteries, nickel metal hydride batteries or lithium ion batteries. Lithium ion batteries may be preferred in some embodiments of the disclosure. These are by way of example only and any suitable rechargeable battery may be incorporated in the battery pack. The battery pack 86 includes any suitable number of rechargeable batteries that can be incorporated in the battery compartment 82. However, it should be appreciated that the individual chargeable batteries are held in place by the housing 86 containing them so that the rechargeable batteries cannot be removed there from. In one embodiment of the present disclosure, the housing may be such that the rechargeable batteries are permitted to be removed and replaced. In this modification, a mechanism is provided for holding the batteries in place. For example, the housing may be a two-part-housing with a fastening mechanism provided to hold the two parts of the housing together. The fastening mechanism may be such that it can be operated to allow the two parts to be separated.

The part 86 housing the rechargeable batteries can be fixed to the lid 84. The lid has four projections 88 which extend from the inner surface of the lid 84 so as to extend into the battery compartment. The projections are thus perpendicular to the plane of the lid. The projections 88 have a length L which is greater than the width w of the projections. The length L is such that this is in respect of the surface which contact the battery pack, when is place. The projection has a height h which is in a direction perpendicular to the plane of the lid and is such that a respective projection 88 can engage a respective projection 89 on the battery pack. w is perpendicular to the height h and the length l.

Each projection 88 of the lid is arranged to have at the end remote from the lid a sloping surface 91. The surface slopes from a region near the end of the projection, downwardly and away from the surface of the projection.

The corresponding projections 89 on the battery pack have a surface 95 extending at right angles to the battery pack surface on which the projection 89 is provided. An inwardly sloping surface 93 is provided which extends from the end of surface 95 towards the surface of the battery pack on which the projection 89 is provided. This means that when the battery pack is placed between the four projections 88 of the lid, the sloping surface 93 of the projection on the battery pack slides over the sloping surface of the projection on the lid. The end of the projection on the lid then engages with the surface 95 to retain the battery pack 86 on the lid 84. The projections 89 are arranged to flex slightly to allow them to be moved into engagement with the respective projections on the lid.

Removing the battery pack from the lid, requires the user to pull the battery pack from the lid with a force sufficient to cause the projections 89 on the battery pack to flex such that the projections on the lid and battery pack are disengaged from one another.

The projections 88 on the lid are surrounded on either side in the direction of the length l by guide members 97. The guide members 97 may ensure that the battery pack is positioned correctly on the lid.

It should be appreciated that the above described mechanism is a push fit mechanism. Any other suitable push fit mechanism can alternatively be used. In alternative embodiments, any other suitable mechanism can be provided to attach the battery pack to the lid.

Figure 5:
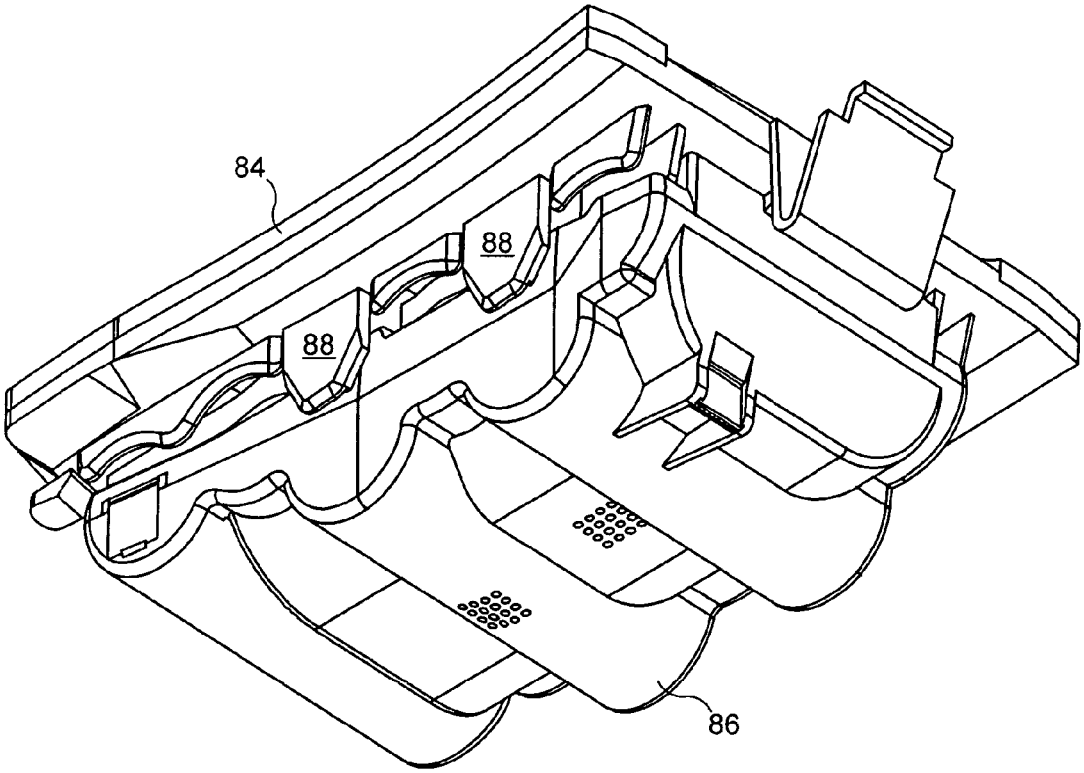
FIG. 5 shows the battery pack and battery compartment lid of FIGS. 4*a* and 4*b* in an assembled state.

As can be seen FIG. 5 which shows the battery pack 86 fixed to the lid 84, the battery pack is accommodated between respective pairs of the projections 88. These projections 88 thus assist in positioning the battery pack 86 on the lid 84.

In order to insert the battery pack into the battery compartments, the two tabs 90 on one end of the lid are inserted into a corresponding pair of recesses 92 provided at one end of the battery compartment. The lid is then rotated about the axis defined by the projections 90 accommodated in the respective recesses so as to bring the outer surface 94 (see FIG. 2) of the lid such that it is in the closed position. Thus, the battery pack 86 is accommodated internally in the battery compartment 82 and covered the lid 84.

The lid has a V-shaped member 96 on the side of the lid opposite to that on which the projections 90 are provided. This V-shaped projection is sprung. When the lid is inserted, the projection is forced into a compressed state by wall 98. This means that the V-shape 96 is in a compressed state and its force acts on the one hand in the direction of arrow A to retain projections 90 in the corresponding recesses 92 and on the other hand to force the side 100 of the V-shaped member 96 closest to wall 98 in contact therewith to retain the lid in place. This is represented by arrow B.

One feature is the ribs 83 at an offset of the snap-fit ribs, i.e. projections 88, which hold the alkaline batteries in place, when no battery pack is used. These ribs are parallel to guide members 97 and spaced inwardly with respect to these members. If ribs 83 were not available then the same battery lid cannot be used for alkaline batteries. The guide members 97 next to the snap-fit ribs cannot hold the alkaline batteries because at that position there are not alkaline batteries below, but the battery contact springs.

Figure 4C:
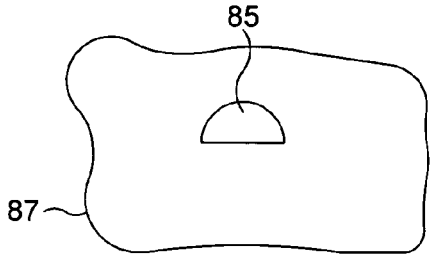
FIG. 4*c* shows a part of the surface of the battery pack which is use is covered by the lid.

In preferred embodiments of the disclosure, there is also a rib or any other suitable arrangement which can be gripped by a user, provided on the battery pack itself, for easy removal of the battery pack from the battery bay in case the battery pack remains in the battery bay after removal of the battery lid. This is illustrated in FIG. 4*c* which shows a rib 85 which projects from the surface 87 of the battery pack which is use is covered by the lid. The rib or the like may project from the surface. Alternatively, one or more indentations may be provided on the surface 87 of the battery pack such that the rib or the like can be gripped by a user. One or more such ribs may be provided.

The rechargeable battery pack is rechargeable when the battery pack is installed in the tape printing apparatus and the tape printing apparatus is plugged into the mains supply.

A modification to the arrangement of FIGS. 4 and 5 will now be described. In one modification a separate battery pack is provided. The battery pack is inserted into the battery compartment and then the battery compartment lid is used to close the battery compartment lid.

In this latter arrangement, the battery pack may be based on the arrangement shown in FIGS. 4 and 5. However, the elements 89, 93 and 95 of the battery pack may be omitted and the lid which is used to cover the compartment may not have element 91. Generally those elements of the battery pack and the lid which are provided to allow the battery pack and lid to be engaged one with the other may be omitted. In this embodiment the lid can be regarded as being a support for the battery pack.

Reference is now made particularly to FIGS. 2 and 3. As can be seen from FIG. 2, an exit slot 110 is provided from which the label exits. The exit is shaped so that the user is able to insert their finger a certain distance into the slot. In particular, the user is able to insert their fingers to remove a label. However, the slot is sized such that the user is not able to insert their finger into the path of the cutting blade during cutting. In particular, the distance between the opposed walls defining the tape exit 115 at the position adjacent to the cutting blade is X. X is generally relatively small and for example may be the order of a few millimeters. The size is much smaller than a finger.

However, in some embodiments of the disclosure, the tape exit design is to create a zone in which the user could put his finger to lift out the cassette in case of tape jams and when the cassette could not be lifted by means of the ejectors or similar mechanism. As the blade cuts into the cassette, the user is not at risk of cutting his finger (particularly if the cutting mechanism cannot be operated in the absence of a cassette or if the lid is open) and in this scenario the distance between the opposed walls defining the tape exit can be larger. In one embodiment, the distance between the walls may be between 15 and 25 mm and around 18 to 22 mm in some embodiments.

The parallel walls on either side of the cut zone may define an area having a length between 10 and 20 mm, for example 13 and 19 mm. The wall may be of different lengths. In one embodiment, one wall may be around 18-19 mm whilst the other may be around 13 to 14 mm with the longer wall being the side on which the cutter is housed.

Immediately beyond the cutting position 48 the walls of the exit slot diverge to form a generally V-shaped arrangement. The V-shaped arrangement has the advantage that the cassette can be accessed if required and/or a cut label, but at the same time a degree of protection is provided for the area adjacent the cutting area from accidental insertion of items in that area. Additionally some protection against impact is also provided. In preferred embodiments of the present disclosure, the walls of the exit beyond the tape cutting position are generally curved. In preferred embodiments of the present disclosure, the curved walls are generally convexly shaped. In the embodiment shown in the drawings, the degree of curvature provided by the walls differs. Accordingly, one wall 111 may be a general continuation of the wall defining the exit slot 110 adjacent to the cutter but merely with a rounded edge or corner whilst the other wall 113 may have relatively large angle with respect to the longitudinal axis of the exit slot at the cutting position. The walls may have a maximum separation distance of between 60 and 70 mm and may for example be in the region of 63 to 65 mm.

The curve walls are advantageous in that the label is curled from being held on the supply spool. The label will follow the curved wall making it easier for the user to remove the label. In one embodiment, the label will be arranged to follow the curve of wall 113. This wall may have a length in the region of 40 mm. However in alternative embodiment, the label will follow the curve of wall 111. This wall may have a length in the region of 13 to 15 mm. This is dependent on the position of the supply spool and how it is guided out of the tape printing apparatus.

In alternative embodiment of the disclosure, the walls are straight, curved concavely, or have different shapes. The wall may be symmetrical with respect to one another or asymmetric By having the user able to remove the label as soon as it has been cut, this means that there is no limitation put on the length of labels that can be provided on account of the distance between the cutting position and the exit slot. Accordingly, the only limitation provided on the length of the label is that it needs to be slightly larger than the distance between the print head and the cutting arrangement. This means that relatively short labels can be provided.

In the alternative or additionally, by having the user able to insert their fingers into the exit slot to contact the cassette and to thereby act on the cassette, the cassette can be removed from the cassette receiving bay. The lid may be open in this situation. This is useful where the cassette has got stuck because of a tape jam and/or because the cassette ejector mechanism is not working properly. It should be appreciated that one cause of the ejector mechanism not working correctly is a tape jam.

In FIGS. 1 and 2, a protective bumper 112 is illustrated by cross-hatching. The cross-hatching is a rubber material. The protective bumper 112 is arranged to surround the edges of the top surface containing the keyboard. In one embodiment, there is no protection provided on the area adjacent the display 4, next to the top end of the tape printer. It should be appreciated in an alternative embodiment; this area may also be provided with a protective bumper 112. The bumper 112 is arranged to cover the left and right sides of the printer. The left and right sides may each comprise a plurality of indented portions. These indented portions are provided to assist the user in holding the tape printer so that it does not slip out of their hand. It should be appreciated that as an alternative to having indented portions, the same functionality may be provided by protruding portions or any other suitable pattern.

The front side surface is provided with a hook 116 by which the label printing apparatus may be attached to a cord or the like so that the label printing apparatus may for example be worn round a user's neck. The opposite side surface may only partially comprise a protective bumper. However, in alternative embodiments of the present disclosure, the entire surface apart from the tape exit slot may be provided with the bumper material. This can be seen more clearly from FIG. 2.

As can be seen from FIG. 2, the rubber bumper is provided on part of the rear surface of the label printer. The rubber material may be provided at least partially on the cassette bay lid 118. In alternative embodiments of the present disclosure, no protective material may be provided on the lid or completely on the lid.

In the embodiment shown in FIG. 2, no protective material is provided on the battery compartment lid 84. However, it should be appreciated that in alternative embodiments, the battery compartment lid may at least partially be covered in protective material. Thus, the protective bumper is arranged generally around the edge of the rear surface. There may be a portion adjacent the tape slot 110 which does not have any bumper material 112. However, in alternative embodiments, this area may also be covered with a protective bumper.

As shown in FIG. 2, there are feet 117 which are arranged on the underside of the label printing apparatus and when the label printing apparatus is put down, the label printing apparatus rests on these feet. At least some and preferably all of the feet comprise the rubber material. Preferably four of these feet are provided although in alternative embodiments, more or less than four feet may be provided. Two of the feet may be provided on the battery compartment lid and two of the feet are provided on the cassette bay lid. However this is by way of example only the feet may be provided on any other suitable locations on the label printing apparatus. For example, one or more of the feet may be provided on the housing. There may be no feet on the cassette bay lid and/or on the battery compartment lid. Only some and not all of the feet may be of the protective material.

In preferred embodiments of the present disclosure, the rubber material is provided an injection moulding step. Thus, the plastic housing is either formed first and then the rubber material is injection molded as part of the injection molding process to provide the bumper. Alternatively, the bumper may be formed in the first injection molding step and then other parts of the housing or lid are then formed of plastic material in a second or further injection molding process.

It should be appreciated that in alternative embodiments of the present disclosure, the rubber bumper may be formed separately and welded, glued or jointed in any suitable way to the plastic housing.

The bumper is preferably of a rubber material but in alternative embodiments may be formed of any other suitable resilient material. The housing is preferably made of plastics but may be made of any other suitable material in alternative embodiments of the present disclosure.

In one preferred embodiment of the disclosure, the rubber material used is a material which has the following characteristics:

| | |
|---|---|
| specific gravity | 1.09 |
| hardness | 60 (Shore A) |
| tensile strength | 94 kg/cm$^2$ |
| elongation | 500% |
| 100% flexible modulus | 54 kg/cm$^2$ |
| Tear strength | 43 kg/cm |

Preferred materials have the above characteristics with +/−20% of the values given, more preferably +/−10% of the values given.

The rubber material preferably has a wide temperature service range, for example between −40° C. and 95° C.

Embodiments of the present disclosure have been described in the context of an arrangement in which a cassette containing an ink ribbon and image receiving tape are used. It should be appreciated that alternative embodiments of the present disclosure may be used with a direct thermal material. This means that the need for the ink ribbon can be omitted. In a still further embodiment of the present disclosure, a two-cassette system may be used where the ink ribbon is accommodated in one cassette and the image receiving tape is accommodated in a different cassette.

In yet another alternative embodiment of the present disclosure, the image receiving tape may simply be provided on a roll without any cassette present.

Preferred embodiments of the present disclosure have been described in the context of a continuous image receiving tape. It should be appreciated that alternative embodiments of the present disclosure may be used with die cut labels, that is discrete labels which are adhered to a continuous backing layer.

Alternative embodiments of the present disclosure may use a further laminating tape which is used to protect the printed image. A number of different techniques are known for achieving lamination.

Embodiments of the present disclosure are preferably hand-held tape printing apparatus. However, alternative embodiments of the present disclosure may be arranged to be connected to a PC. Some embodiments of the present disclosure may be used both as a stand-alone printer and alternatively as a PC connected device.

If the tape printing apparatus is to be used solely as a PC connected device, the keyboard may at least partially or completely be omitted. Likewise, the display may be at least partially or completely omitted.

Preferred embodiments of the disclosure have been described in the context of a printer which uses direct thermal transfer printing techniques or thermal transfer via ink ribbon techniques. It should be appreciated that embodiments of the present disclosure are not limited to these technologies and can use any other suitable printing technology such as ink jet printing or laser printing.

The invention claimed is:

1. A tape printing apparatus comprising:

an opening in said tape printing apparatus for accessing a tape accommodation area for accommodating a cassette comprising a supply of image receiving tape;

a cutting arrangement, wherein said cutting arrangement comprises a blade arranged to co-operate with a cutting location on a wall of said cassette; and an outlet positioned downstream of said opening and arranged adjacent said cutting arrangement, said outlet having a first part downstream of the cuffing arrangement with a size such that a user is able to access an area adjacent said cutting arrangement, said tape accommodation area being arranged to accommodate said supply of image receiving tape in a cassette, and said outlet is sized to permit the user to directly contact a surface of said cassette via said outlet, and to create a zone in which the user can insert a finger to remove a label or to lift out the cassette in case of a tape jam.

2. A tape printing apparatus as claimed in claim 1, wherein said size is such that the user is able to access a cut portion of image receiving tape.

3. A tape printing apparatus as claimed in claim 1, wherein said outlet comprises a second part upstream of said first part.

4. A tape printing apparatus as claimed in claim 3, wherein said second part comprises first and second parallel wall portions defining a path for said image receiving tape.

5. A tape printing apparatus as claimed in claim 3, wherein said second part has length of between 10 and 20 mm.

6. A tape printing apparatus as claimed in claim 1, wherein said first part comprises first and second walls, at least one of which diverges from the other.

7. A tape printing apparatus as claimed in claim 6, wherein at least one of said first and second walls of the first part is curved.

8. A tape printing apparatus as claimed in claim 7, wherein said at least one of said first and second walls of the first part is convexly curved.

9. A tape printing apparatus as claimed in claim 7, wherein said at least one wall of the first part is convexly curved and the image receiving tape is curved along one of said at least one wall.

10. A tape printing apparatus as claimed in claim 6, wherein said outlet comprises a second part upstream of said first part and wherein one wall of said first part is a continuation of a wall of the second part.

11. A tape printing apparatus as claimed in claim 6, wherein said outlet comprises a second part upstream of said first part, said second part comprises first and second parallel wall portions defining a path for said image receiving tape, and said first and second walls of the first part are asymmetric with respect to the second part.

* * * * *

UNITED STATES PATENT AND TRADEMARK OFFICE

CERTIFICATE OF CORRECTION

PATENT NO. : 8,672,565 B2
APPLICATION NO. : 12/594584
DATED : March 18, 2014
INVENTOR(S) : Kris Vandermeulen It is certified that error appears in the above-identified patent and that said Letters Patent is hereby corrected as shown below:

In the Claims:

At Column 10, line 55, “cuffing” should be -- cutting --.

Signed and Sealed this
Twelfth Day of May, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,672,565 B2
APPLICATION NO. : 12/594584
DATED : March 18, 2014
INVENTOR(S) : Kris Vandermeulen It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 613 days.

Signed and Sealed this
Twenty-ninth Day of September, 2015

Michelle K. Lee

Michelle K. Lee
*Director of the United States Patent and Trademark Office*